United States Patent [19]

Keegan

[11] 4,234,188

[45] Nov. 18, 1980

[54] MODULAR CHESS SET

[76] Inventor: Robert R. Keegan, 1825 Susan Dr., Fayetteville, Ark. 72701

[21] Appl. No.: 628,475

[22] Filed: Nov. 5, 1975

[51] Int. Cl.[3] ..... A63F 3/02

[52] U.S. Cl. ..... 273/290; 46/25

[58] Field of Search ..... 273/137 R, 137 F, 160, 273/288, 290; 46/23, 25, 26

[56] References Cited

U.S. PATENT DOCUMENTS

| | | | |
|---|---|---|---|
| 436,310 | 9/1900 | Hoyt | 273/243 |
| 2,482,402 | 9/1949 | Corcodilos | 46/26 X |
| 3,751,039 | 8/1973 | Dykoski | 273/137 F |
| 3,871,657 | 3/1975 | Lorenz et al. | 273/137 F |

FOREIGN PATENT DOCUMENTS

| | | | |
|---|---|---|---|
| 1219634 | 12/1959 | France | 46/25 |

*Primary Examiner*—Anton O. Oechsle
*Attorney, Agent, or Firm*—Robert R. Keegan

[57] ABSTRACT

There is disclosed a chess set, which in its assembled form includes the customary sixteen pawns and sixteen major pieces, but in which all six forms of the pieces consist of, or are assembled from, just three pieces representing the pawn, the knight and the bishop; the assembly is accomplished by forming interlocking stacks from two or more of the basic pieces which are preferably cruciform in shape with either a central projection or central opening.

10 Claims, 19 Drawing Figures

MODULAR CHESS SET

This invention relates to a set of chess pieces each of which has a simple symbolic design and in which the king, queen and rook are assembled from modules of three different forms which represent the bishop, knight and pawn.

A number of advantages result from the modular nature of the set. Its manufacture is simplified by the fact that only three different shapes instead of six need be produced. As another advantage, there are many similar modules utilized in forming the major pieces so that modules may be used to play other games such as checkers or backgammon which require more than eight pieces or markers for each side.

In the game of chess sometimes one player will obtain the right to a second queen, as a result of queening a pawn. It is customary to provide a second queen in such a case by upending a previously captured rook or by some other makeshift procedure. In most cases the disclosed chess set provides a better solution to this problem of providing a second queen in that an identical second queen may be assembled from previously captured pieces; only a rook, knight and pawn or the equivalent are required to assemble a second queen identical to the original.

It is an object of the present invention to provide game-piece modules of a limited number of forms which may be assembled by stacking to make other composite game-piece forms and create a complete chess set or other game set.

It is another object of the present invention to provide a set of game-piece modules respectively having projections and openings allowing composite pieces to be assembled therefrom which are rigid and stable.

It is a further object of the invention to provide cruciform modular game-pieces which can be placed on a board with different aspects to enhance substantially the visual differentials between various pieces.

Other objectives and advantages of the invention will be apparent from consideration of the following description in conjunction with the appended drawings in which.

Figure 2:
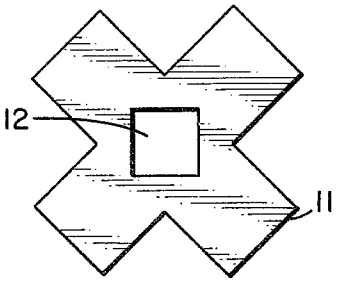
FIG. 2 is a plan view of the device of FIG. 1.
Figure 1:
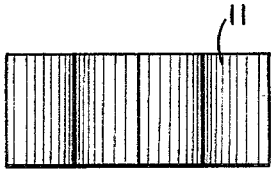
FIG. 1 is an elevational view of the simplest game-piece module according to the invention.
Figure 3:
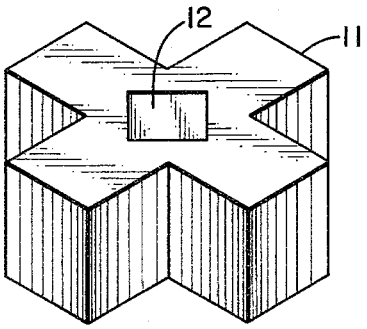
FIG. 3 is a perspective view of the device of FIG. 1.

Referring to FIGS. 1–3, there is shown a game-piece module 11 shaped in the form of a cross and having an opening 12 centrally located therein.

The opening 12 extends completely through the game-piece 11 and for illustrative purposes is shown as square in shape. The square opening 12 is tilted or rotated with respect to the element 11 so that its interior faces are at a 45 degree angle relative to the exterior side faces of the element 11.

The shape of the module 11 and of the opening 12 are preferred shapes shown for illustration but the invention is in no way limited to these shapes. It will be seen that a suitable appearance and proportion is provided if all edges of module 11 are of the same length and the sides of the opening 12 are of somewhat shorter length. More specifically, the diagonal of the opening 12 in FIG. 2 is shown to be equal to an edge of module 11.

The invention is not limited to the shapes shown and other shapes may be used for the modular elements such as cylindrical shape, a semi-spherical shape or the like. The same is true with respect to the opening 12. Also the proportion could be varied within a wide range departing in greater or less degree from the equilateral form illustrated. The opening may be made of the same size as one arm of the cross thereby greatly increasing the possible combinations for modular assemblies since the opening would engage with the arms of other modules.

The module 11 of FIGS. 1–3 is the simplest of the modules of which the set is formed and is intended to be the pawn of the chess set. It is contemplated that it be placed flat on the board in its most stable position. It could, however, be placed erect on the board standing on one of its four arms, if desired.

Figure 5:
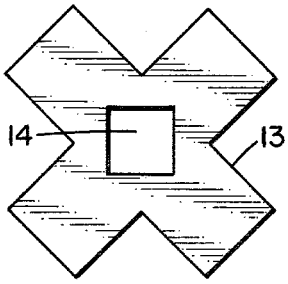
FIG. 5 is a plan view of the device of FIG. 4.
Figure 4:
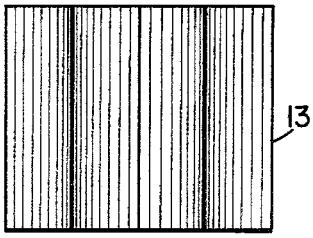
FIG. 4 is an elevational view of a second game-piece module for use as a chess bishop according to the invention.
Figure 6:
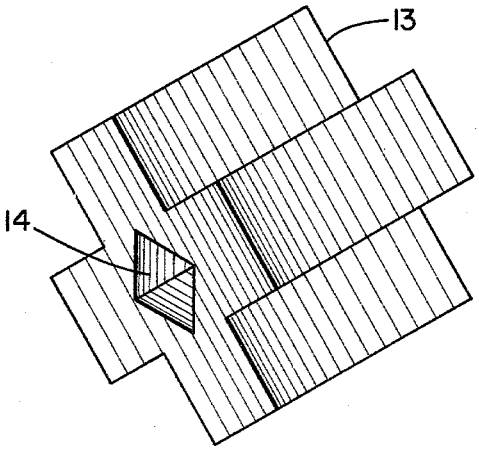
FIG. 6 is a perspective view of the device of FIG. 4.

FIGS. 4–6 show the second type of module 13 which is simply a double-size version of the module 11. Module 13 is provided with a square center hole as was module 11. The faces of the exterior of the module 13 are shown as being plain and smooth, but it may be desired to provide a score mark around the module 13 to give the appearance of two modules 11 being stacked together.

The module 13 is intended to be used as the chess bishop, and to symbolize the bishop's diagonal movement, the piece is placed to rest on the board on the edges of two of its four arms, thereby presenting the appearance of an X as seen in FIG. 6.

Figure 8:
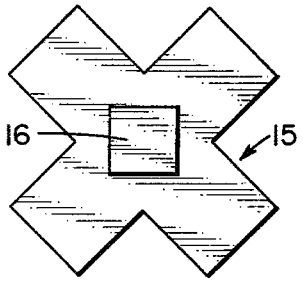
FIG. 8 is a plan view of the device of FIG. 7.
Figure 7:
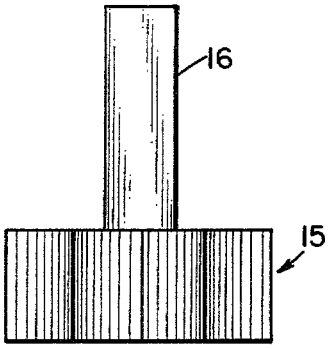
FIG. 7 is an elevational view of a third game-piece module for use as a chess knight according to the invention.
Figure 9:
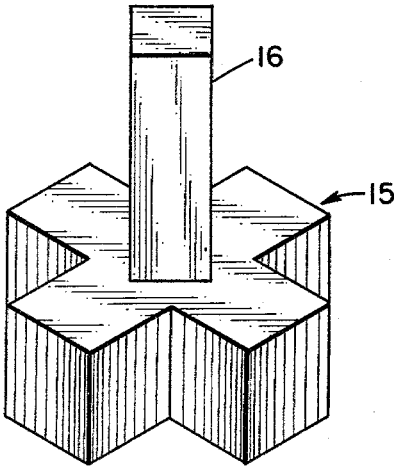
FIG. 9 is a perspective view of the device of FIG. 7.

FIGS. 7–9 show the third type of module 15 which has the shape of module 11 except that the square center hole is replaced with a projection or pillar 16 extending to a height three times that of the base of the module 15. The projection 16 could be a separate member seated in a hole at the base of module 15 or the entire piece could be formed as a unit.

The module 15 forms by itself a knight of the chess set and is intended to be placed with the orientation shown in FIG. 6 for maximum stability, although some other orientation could be used by the choice of the players.

Figure 11:
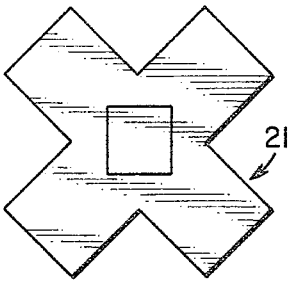
FIG. 11 is a plan view of the device of FIG. 10.
Figure 10:
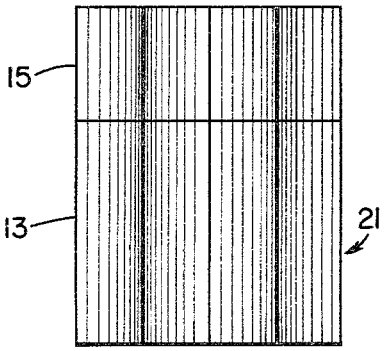
FIG. 10 is an elevational view of a modular game-piece for use as a chess rook to be formed of modules as shown in FIGS. 4–9 according to the invention.
Figure 12:
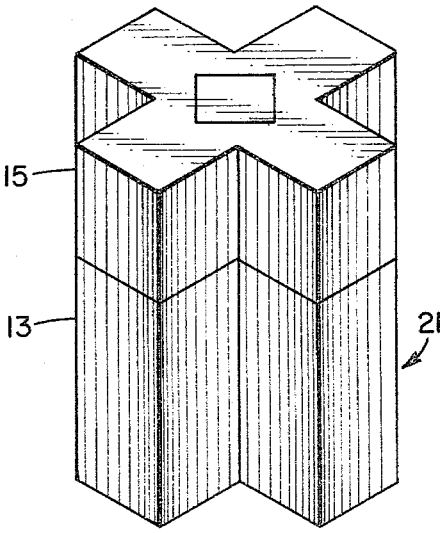
FIG. 12 is a perspective view of the device of FIG. 10.

The other chess pieces are formed by assembling two or more modules illustrated in FIGS. 1–9. FIGS. 10–12 show a modular piece 21 consisting of one module 15 and one module 13, the former stacked on the latter with the pillar 16 inserted in the opening 14. The modular piece 21 is the rook of the chess set.

Alternatively, a rook could be assembled with one module 15 and two modules 11. The use of two modules 11 would have the advantage of increasing the number of such modules in the chess set for use as pieces of markers in some other game, e.g. checkers or backgammon. The modular piece 21 representing the rook is intended to be placed on the board with the orientation shown in FIG. 10.

Figure 14:
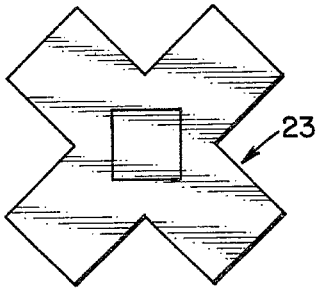
FIG. 14 is a plan view of the device of FIG. 13.
Figure 13:
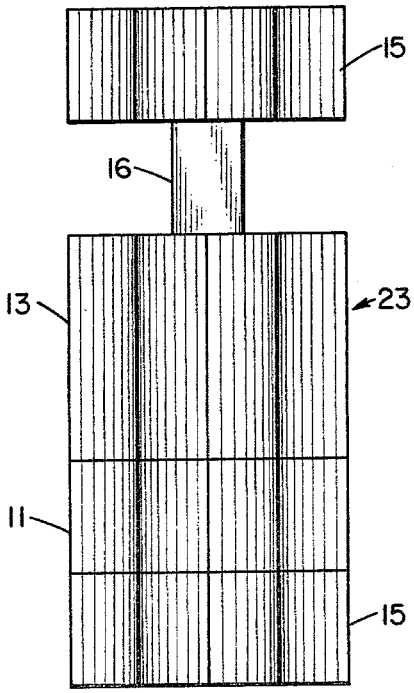
FIG. 13 is an elevational view of a modular game-piece for use as a chess queen to be formed of modules as shown in FIGS. 1–9 according to the invention.
Figure 15:
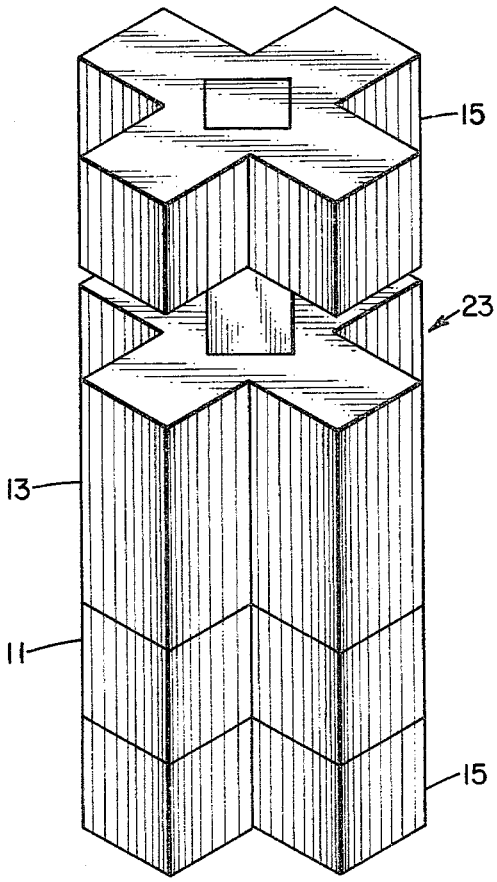
FIG. 15 is a perspective view of the device of FIG. 13.

FIGS. 13–15 illustrate a modular game-piece 23 used as the queen in the chess set. Game-piece 23 consists of two modules 15, one module 11 and one module 13. Game-piece 23 is assembled by stacking from bottom to top a module 15, a module 11, a module 13, and another inverted module 15. It will be noted that the module 13 overlaps the pillars 16 of the upper and lower modules 15 to provide a rigid and stable modular game piece; preferably the projection or pillar 16 is a snug, slightly binding fit in the opening 14 so that the modular piece 23 can be lifted by the top or any other portion without coming apart. At the same time, the piece should be capable of being disassembled without excessive force. Game-piece 23 is to be placed on the board as illustrated in FIG. 13.

Figure 17:
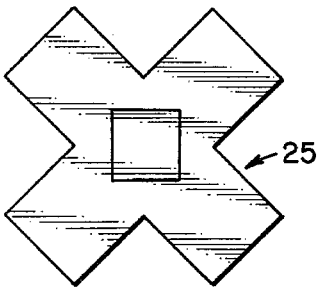
FIG. 17 is a plan view of the device of FIG. 16.
Figure 18:
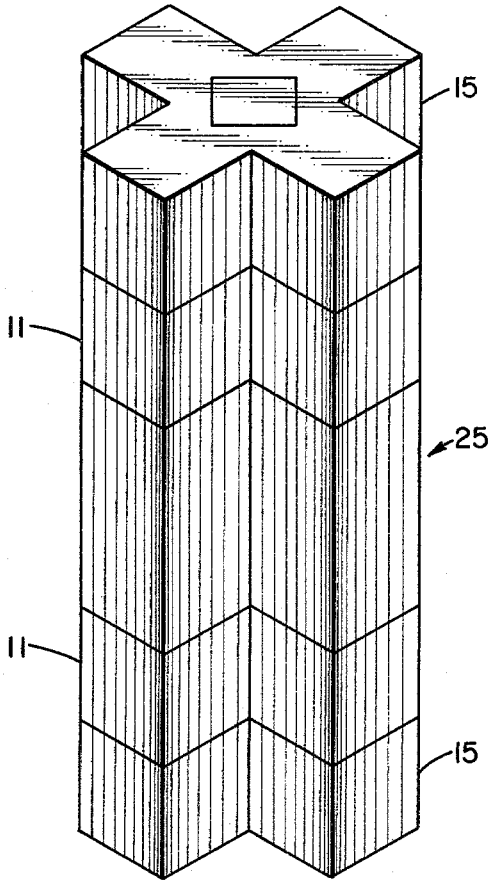
FIG. 18 is a perspective view of the device of FIG. 16.
Figure 16:
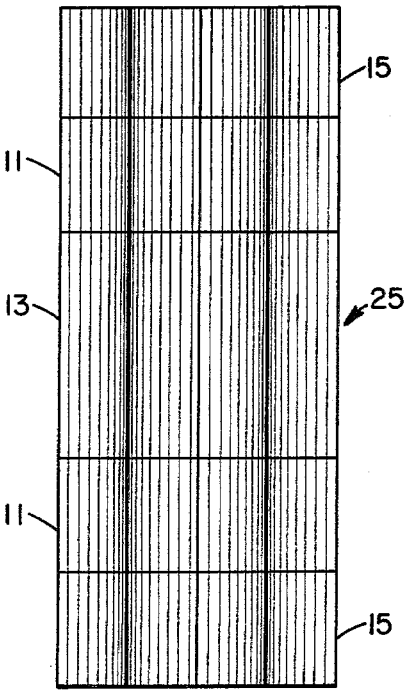
FIG. 16 is an elevational view of a modular game-piece for the use of a chess king to be formed of modules as shown in FIGS. 1–9 according to the invention.

FIGS. 16–18 illustrate a game-piece 25 to be used as the chess king; it is similar to the game-piece 23 except that it has five rather than four modular pieces, two modules 15, two modules 11 and one module 13 stacked in the order of 15, 11, 13, 11 and 15. Game-piece 25 is assembled to create a rigid structure in the same manner as described with respect to game-piece 23. Game-piece 25 is to be placed on the board with an erect orientation as illustrated in FIG. 18.

Figure 19:
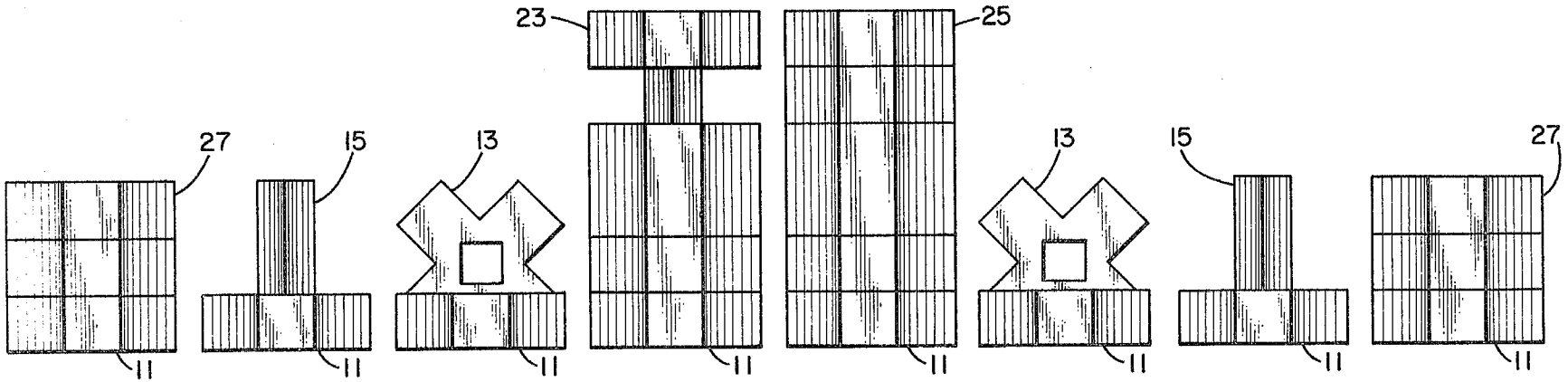
FIG. 19 is an elevational view of a complete chess set with pieces as shown in FIGS. 1–18.

FIG. 19 illustrates one half of the chess set comprising one or more of each of the game-pieces described above. It will be understood that the chess set consists of two sides each as illustrated in FIG. 19 except that each one would be a different color for the purpose of distinguishing the sides. Typically, the chess pieces illustrated in FIG. 19 might be white while the other half of the set would consist of black pieces otherwise identical to those of FIG. 19. Of course, other colors may be used or the pieces could be multi-colored, so long as there is a clear distinction between opposing sides. Eight pawns, one in front of each of the major pieces, are shown in FIG. 19.

In FIG. 19 there are two pieces 15, eight pieces 11, two pieces 13, a piece 25 and a piece 23 for which further description is unnecessary in view of the detailed description above. Note that the rooks are different from piece 21 and bear reference numbers 27. Each rook 27 is formed of one module 15 and two modules 11. As previously suggested, it is a matter of choice whether the rook be formed in the manner of piece 21 or piece 27.

The chess set according to the invention and illustrated in FIG. 19 has particular advantages in aiding a player to learn the elements of the game. It will first be noted that the shape of the pieces is strongly suggestive of the moves which they are allowed to make. The cross shape of the rook suggests its movement in four directions along the rows or columns of the chess board. The knight, piece 15, gives the appearance of an inverted T and suggests the chess move of the knight consisting of two squares in a first direction and one square in a direction at right angles. Furthermore, the knight has faces which face in eight different directions illustrating the eight possible movements of a chess knight. The bishop, piece 13, is placed on the board to present the appearance of an X and clearly suggests the diagonal movement of the chess bishop.

The modular piece 23 representing the queen has faces which face in eight different directions representative of the eight directions of unlimited movement of the queen.

The king, piece 25, has a shape which is perhaps less strongly suggestive of its one square at a time movement. Its shape, however, by its massive unitary form suggests the all-important role of the king in the game.

At first impression the pawn pieces 11 do not appear to suggest pawn movement. Consider, however, the possible movement of a central pawn from its initial position on the second row of the chess board. It will be found that there are four possible squares to which it can move under various circumstances and that these taken together with the starting position form a cross exactly the shape of the pawn pieces.

The manner in which the pieces symbolize the movement of which they are capable has been explained to show that the modular nature of the chess set is achieved without sacrificing this symbolic shape and appearance.

As a matter of instructing a player in chess principles it is also noteworthy that the bulk of the pieces and the quantity of modules in the modular pieces comes very close to representing the average playing values of the respective pieces (except for the king, of course, whose value is beyond measure). For example, a knight and a bishop are about the value of a rook; a rook, a knight and a pawn are about the value of a queen; a bishop, two knights and a pawn approximate the value of a queen, etc.

As previously mentioned, the modular construction of the chess set permits an extra piece, usually a queen, to be assembled from the previously captured pieces. Since a queen consists of only one module 11, one module 13, and two modules 15, it would almost always be possible to assemble a queen from previously captured pieces at the stage of a chess game when the queening of a pawn might occur.

It is contemplated that the chess set would be assembled and sold in assembled form. It could be sold unassembled, however, as it should include illustrated directions for assembly in any case.

The modular design of the chess set according to the invention has the advantage that there are few assemblages possible with the modules which are not utilized as a piece in the chess set. In other words, it is relatively difficult to put the chess set together the wrong way. On the other hand, there is some advantage in extending the game-pieces to a greater number of possible pieces for use in games other than the traditional chess game. For example, there are three-dimensional chess games which require additional pieces. If one wished to increase the possible number of ways to assemble the modular pieces, this can readily be done by making the openings 12 and 14 and the projection octagonal. This would permit many variations in the way that the pieces were stacked; since they could then be stacked out of alignment whereas the illustrated embodiment forces the modules to be stacked in alignment.

The material of which modules are made is not deemed to be an important factor, but wood, plastic, ceramic, metal, or other similar materials would be suitable. Preferably the material would permit a snug, somewhat binding, fit in the projection 16 in the opening 14 as previously described.

In addition to the variations and modifications to the invention which have been suggested or described, other modifications and variations will be apparent to those of ordinary skill, and the scope of the invention is not to be limited to the specific arrangements shown, but is rather to be determined by reference to the appended claims.

What is claimed is:

1. A set of game-pieces comprising at least four groups of pieces, the pieces of the first group being of a first configuration having a cruciform, substantially uniform, horizontal cross-section, the pieces of the second group being of a second configuration different from said first configuration and shaped for engagement with a piece of said first configuration, the pieces of the third group being formed of at least two modules having said first and second configurations, and the pieces of said fourth group being formed of at least three modules having said first and second configurations.

2. A set of game-pieces as claimed in claim 1 wherein there are at least five groups of pieces, and the pieces of the fifth group being of a third configuration different from said first or second configuration.

3. A set of game-pieces as claimed in claim 2 wherein there are six groups of pieces, the pieces of the sixth group being formed of at least four modules having said first, second and third configurations.

4. A set of game-pieces as claimed in claim 1 wherein said first configuration includes an opening and said second configuration includes a projection insertable in said opening.

5. A set of game-pieces comprising (a) a plurality of pieces each of cruciform shaped cross-section and having a central opening with its axis perpendicular to the plane of said cross-section;

(b) a plurality of pieces of substantially the same cross-section as said pieces in (a) above and greater thickness;

(c) a plurality of pieces each having a base portion and an upwardly extending portion extending centrally therefrom said base portion having except for said opening substantially the same cross-section and thickness as in said pieces in (a) above, said upwardly extending portion being adapted to fit into the opening in one of said pieces in (b) above;

(d) a plurality of pieces each comprising at least two modules at least one being a piece such as described in (a) or (b) above and one as described in (c) above with its upwardly extending portion engaging the opening in the other module;

(e) a plurality of pieces each comprising at least three modules, at least one being a piece such as described in (b) above and one as described in (c) above and an inverted form of that one described in (c) above with the upwardly and downwardly extending portion of the last said two pieces engaging the opening in the other module; and (f) two pieces at least substantially as tall as the pieces described in (e) above.

6. A set of game-pieces comprising (a) a plurality of pieces each of cruciform shaped cross-section and having a central opening with its axis perpendicular to the plane of said cross-section;

(b) a plurality of pieces each having a base portion and an upwardly extending portion extending centrally therefrom said base portion having except for said opening substantially the same cross-section and thickness as in said pieces in (a) above, said upwardly extending portion being adapted to fit into the opening in one of said pieces in (a) above;

(c) a plurality of pieces each comprising at least two modules at least one being a piece such as described in (a) above and one as described in (b) above with its upwardly extending portion engaging the opening in the other module;

(d) a plurality of pieces each comprising at least three modules, at least one being a piece such as described in (a) above and one as described in (b) above and an inverted form of that one described in (b) above with the upwardly and downwardly extending portion of the last said two pieces engaging the opening in the other module; and (e) two pieces at least substantially as tall as the pieces described in (d) above.

7. A set of game pieces as recited in claim 5 wherein said upwardly extending portion is of square horizontal cross-section.

8. A set of game pieces as recited in claim 5 wherein said central opening is square.

9. A set of game pieces as recited in claim 6 wherein said upwardly extending portion is of square horizontal cross-section.

10. A set of game pieces as recited in claim 6 wherein said central opening is square.

* * * * *